United States Patent [19]

Doucet

[11] 4,228,735

[45] Oct. 21, 1980

[54] OFFSET DUPLICATING MACHINE

[76] Inventor: Laurent Doucet, 4200 rue Majeau, Montreal Nord Quebec, Canada

[21] Appl. No.: 916,548

[22] Filed: Jun. 19, 1978

[30] Foreign Application Priority Data

Jan. 19, 1978 [CA] Canada ..... 295329

[51] Int. Cl.[3] ..... B41F 13/54

[52] U.S. Cl. ..... 101/227; 83/659; 83/341; 83/346; 101/76

[58] Field of Search ..... 83/659, 341, 346; 101/232, 218, 226, 247, 76, 77

[56] References Cited

U.S. PATENT DOCUMENTS

| | | | |
|---|---|---|---|
| 10,001 | 9/1853 | Allison | 83/341 |
| 2,683,409 | 7/1954 | Dutro et al. | 101/77 |
| 3,068,788 | 12/1962 | Bell et al. | 101/226 |
| 3,106,121 | 10/1963 | Novick | 83/341 |
| 3,203,292 | 8/1965 | Schmermund | 83/341 |
| 3,431,847 | 11/1969 | Smith et al. | 101/226 |
| 3,524,922 | 8/1970 | Johnson | 83/346 |
| 3,554,070 | 1/1971 | Boyd | 101/226 |
| 3,583,269 | 6/1971 | Kobayashi et al. | 83/341 |
| 3,593,987 | 7/1971 | Garber | 101/226 |
| 3,611,921 | 10/1971 | Jahn | 101/232 |
| 4,044,666 | 8/1977 | Doncet | 101/247 |

*Primary Examiner*—William Pieprz

[57] ABSTRACT

In an offset duplicating machine, an implement for marking, such as perforating, slitting, scoring or the like, each printed sheet conveyed through the machine; for transverse marking, a first marking strip is affixed lengthwise on an impression cylinder and a rotatable counter-roller is mounted adjacent and at a skew inclination to the impression cylinder; the counter-roller has an outer surface of hyperboloidal shape which allows the strip to progressively mark the passing sheet. By grooving the counter-roller or by varying the distance separating it from the impression cylinder, additional marking strips may be affixed to the impression cylinder to provide various marking configurations on the printed sheet.

6 Claims, 7 Drawing Figures

OFFSET DUPLICATING MACHINE

FIELD OF THE INVENTION

The present invention relates to offset duplicating machines wherein separate sheets are successively conveyed and imprinted through a series of rotary and impression cylinders; more particularly, the invention pertains to an implement on such machines for marking, such as perforating, slitting, scoring or the like, the printed sheets.

BACKGROUND OF THE INVENTION

Offset duplicating machines are well known; briefly, they comprise a series of rotating cylinders that include principally a first cylinder carrying a printing plate, a blanket cylinder covered by a layer of rubber or the like, and an impression cylinder which presses the sheets against the blanket cylinder.

In my U.S. Pat. No. 4,044,666 issued Aug. 30, 1977, an offset duplicating machine is shown with particular emphasis on the provision of an attachment at the delivery end of the machine for coding each printed sheet successively conveyed through the machine. This patent discloses the use of an additional impression cylinder mounted near the delivery end of the machine to allow the impression of characters on the sheets prior to being delivered at the delivery station of the duplicating machine.

Until now, an offset duplicating machine has not been made that could perforate, slit or score a sheet at it is being conveyed from the feeding station and to the delivery station of the machine.

Some cutting arrangements have been proposed for cutting a longitudinal travelling web wherein a cutting roller having a rotational axis extending transversely to the direction of travel of the web is forced upon the web for cutting. With this type of an arrangement, the cutting operation is carried out instantaneously to effect a chopping action, which operation requires high cutting pressures.

OBJECTS AND STATEMENT OF THE INVENTION

Accordingly, it is an object of this invention to provide in an offset duplicating machine an implement for marking the printed sheets as they successively convey through the printing machine.

It is another object of the present invention to perform perforation, slitting, scoring or the like of sheets in a progressive manner thereby avoiding the problems associated with a chopping action.

It is a further object of the present invention to provide in a duplicating machine a plurality of marking means so that the sheets may be perforated, slit scored or the like in their transverse direction as well as in their longitudinal direction.

It is still a further object of the present invention to provide the above-mentioned transverse and longitudinal marking operations with additional markings of various configurations.

The present invention, therefore, relates to an offset duplicating machine which comprises, in combination: a loading station for stacking sheets to be printed; means for successively conveying separate sheets from the loading station; a printing station for printing sheets conveyed from the loading station; means for transferring printed sheets from said printing station; impression cylinder means receiving the printed sheets from the transferring means and having a rotational axis perpendicular to the axis of travel of the printed sheets; marking means on the impression cylinder means and including a sheet marking edge extending lengthwise of the impression cylinder means; rotatable counter-roller means mounted adjacent the impression cylinder means and having a rotational axis of skew inclination relative to the rotational axis of the impression cylinder means, the counter-roller means having an outer surface of hyperboloidal shape lying adjacent to the outer surface of the impression cylinder means and contacting the marking edge progressively along the length thereof as each sheet passes between the impression cylinder means and the counter-roller means whereby each sheet is marked transversely; and a delivery station for receiving each printed and marked sheet.

It should be understood that the term "marking" used throughout the present disclosure shall mean any conditioning which may be given to a sheet, such as perforating, scoring, slitting or the like. The term shall also mean to cover the operation of cutting a sheet wherein a cutting strip on the impression cylinder will have a length slightly less than that require for complete separation of the printed sheet in two parts; in such case, the sheet is not completely cut and is delivered at the delivery station with the same overall size it had at the feeding station of the duplicating machine.

In one embodiment of the invention, second marking means are mounted transversely to the rotational axis of the impression cylinder to further mark the sheets in a direction perpendicular to the first marking, (or in the direction of travel of the sheets). According to one variant of this embodiment, to prevent the marking edge of the second marking means to contact the counter-roller, a groove is provided on the counter-roller which comes into registry with the second marking edges. In another variant of this embodiment, the height of the first marking edge is slightly greater than that of the second marking edge; however, the distance between the impression cylinder and the counter-roller is varied to suit the height of the first notching edge and to avoid contact by the second marking edge on the counter-roller. With this second variant, it now becomes possible to provide additional marking means on the impression cylinder wherein the height of their marking edges correspond substantially to that of the second marking edge. These additional marking means may have various configurations.

Other objects and further scope of applicability of the present invention will become apparent from the detailed description given hereinafter, it should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
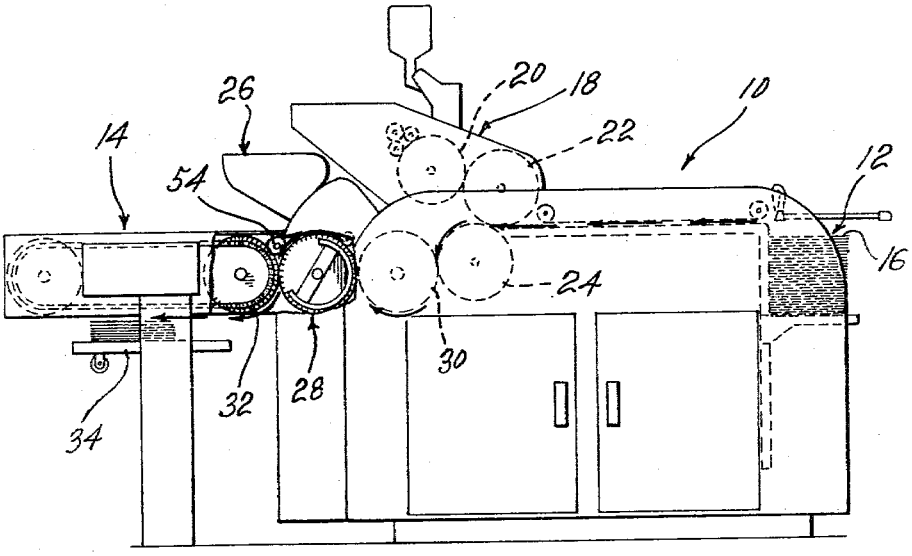
FIG. 1 is a schematic, in elevation, of an offset duplicating machine depicting the travelling of successive sheets from the feeding station to the delivery station and embodying a marking implement made in accordance with the present invention.

FIG. 1 shows the profile of an offset duplicating machine 10 having a sheet loading station 12 and a sheet delivery station 14. These machines are well known in the printing art; basically, they serve to successively feed separate sheets 16 through a printing process. The offset duplicating machine therefore comprises a printing station 18 including principally three rotating cylinders: a plate cylinder 20 which carries the printing plate, a blanket cylinder 22 which is covered by a layer of rubber or the like and an impression cylinder 24 which presses the sheet against the blanket cylinder 22.

As described in my U.S. Pat. No. 4,044,666 issued Aug. 30, 1977, a second printing station 26 may be provided to successively and serially imprint to the printed sheets one or more code characters, such as letters and/or numbers. The provision of a second printing station resulted in attaching to the delivery end of the offset duplicating machine a second impression cylinder 28 rotatably mounted at opposite ends thereof to the sidewalls of the duplicating machine and a gripper bar device 30 which serves to size each sheet received from the first-mentioned impression cylinder 24 and to transfer it onto the second impression cylinder 28. The delivery station 14 includes a chain delivery arrangement 32 that consists also of elements which grip each sheet from the second impression cylinder 28 to deposit it on the delivery loading platform 34.

The present invention is concerned with marking the sheets successively once they have been gone through the first printing station 18. The second printing station 26 may or may not be used. In cases where code characters are or are not required on the printing sheets, the above referred U.S. patent describes how the code applying device of station 26 may be engaged to or disengaged from the duplicatng machine. However, the code applying operation is independent of the marking operation of the present invention.

The following description will make reference to one or more perforator strips as marking means for the printed sheets. However, scorers, slitters or the like may be used to mark the sheets as required. Hence, perforation lines 36 and 38 on sheet 16 in FIG. 5 could be replaced by score lines, slit lines or the like.

Figure 2:
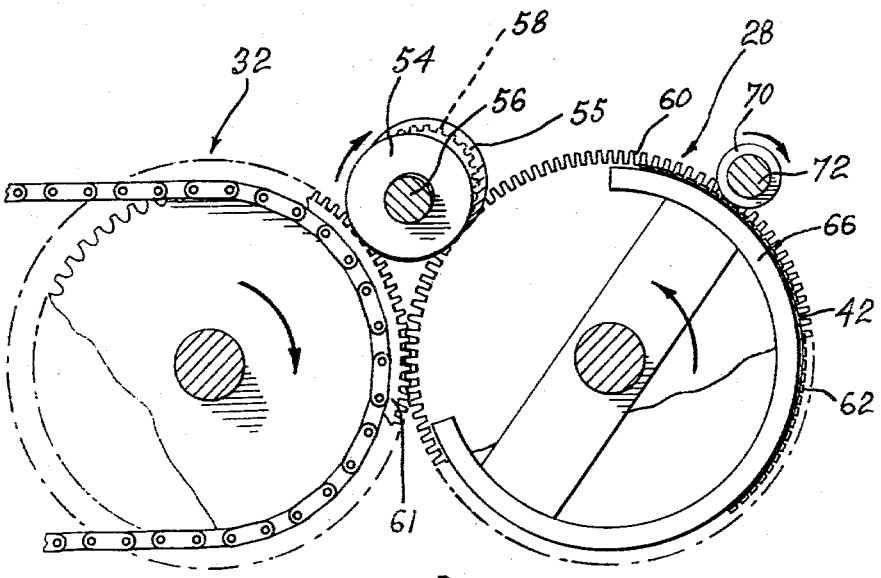
FIG. 2 is an enlarged cross-sectional view illustrating the cooperation of the impression cylinder located adjacent the delivery end of the offset machine with the counter-roller of the present invention.
Figure 4:
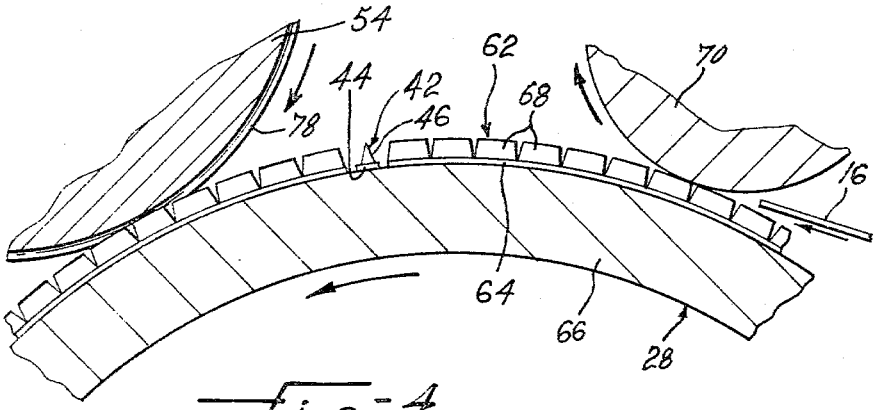
FIG. 4 is a cross-sectional view taken along lines 4—4 of FIG. 3.
Figure 3:
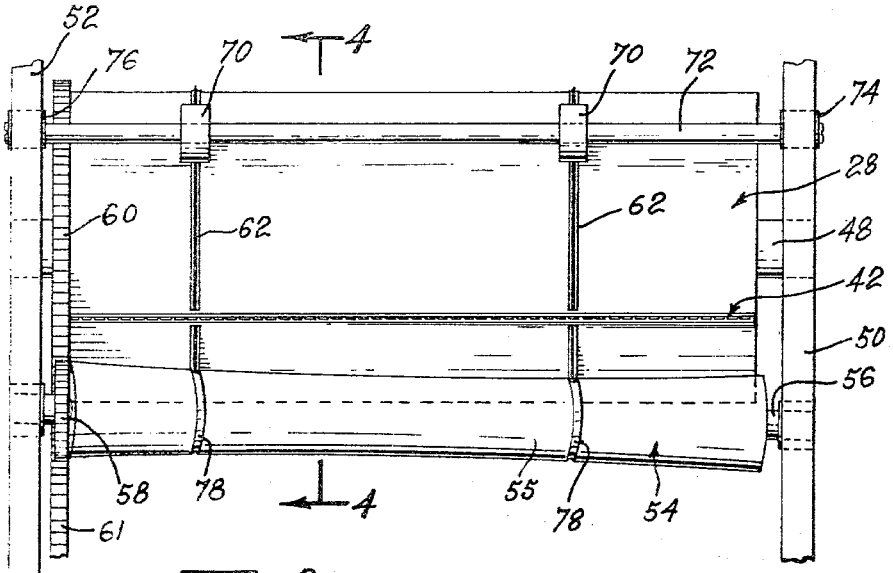
FIG. 3 is a plan view showing the impression cylinder, the counter-roller and pressure rollers for acting on marking strips used in the present invention.
Figure 5:
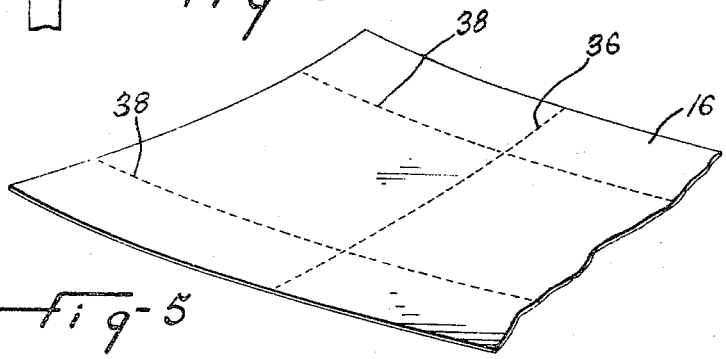
FIG. 5 is a perspective view showing in part a sheet which has been marked both longitudinally and transversely.

Referring to FIGS. 2,3 and 4, the transverse perforation 36 shown in FIG. 5 is made by affixing to the outer cylindrical surface of the impression cylinder 28 a perforator strip 42 that includes a base portion 44, having its backing adhesively secured to the impression cylinder surface, and a series of teeth 46, each defining a perforating edge.

The impression cylinder 28 is mounted on a shaft 48 having its opposite ends rotatably received in side walls 50,52 forming the sides of the machine. The axis of rotation of impression cylinder 28 is perpendicular to the line of travel of sheets 16 through the machine. Also mounted to side walls 50,52 of the duplicating machine is a rotatable counter-roller 54 having a shaft 56 extending in a plane perpendicular to the line of travel of the sheet 16; however, shaft 56 has a skew inclination relative to shaft 48 of the impression cylinder 28. The counter-roller 54 has a longitudinal outer surface 55 of slightly concave hyperboloidal shape; this profile can easily be achieved by means of a grinding machine in known conventional methods. By providing this profile and by inclining the counter-roller relative to the impression cylinder, the perforation of the sheets which pass between the impression cylinder 28 and the counter-roller 54 begins at the left-hand side of the counter-roller (as seen in FIG. 3) and progresses transversely over the sheet to the right-hand side. The perforating operation is done from left to right since the left-hand side of counter-roller 54 is higher than the right-hand side and the sheets pass over impression cylinder 28. There results a straight transverse perforation line 36 at the delivery end.

The rotation of the counter-roller 54 is effected by gear wheel 58 provided at one end of shaft 56, which gear wheel is in meshing engagement with gear wheel 60 mounted at a corresponding end of shaft 48. Gear wheel 60, in turn, is in meshing engagement with gear wheel 61 of the chain delivery system 32 and with a gear wheel (not shown) of the gripper bar device 30.

Another aspect of the present invention is the possibility of simultaneously perforating on the impression cylinder 28 the travelling sheets 16 both transversely and longitudinally. One or more longitudinal perforation lines 38 may be performed on the sheets by disposing on the impression cylinder 28 one or more perforator strips 62 of similar construction to the perforator strip 42. Each perforator strip 62 includes a base 64 having its backing adhesively secured to the impression cylinder surface, and a series of teeth 68, each defining a perforating edge. As seen in FIG. 2, the impression cylinder 68 is not a completely enclosed cylinder and its frame 66 has an arcuate shape of a size sufficient to receive printed sheets thereon. The opened portion of frame 66 allows easy access inside the cylinder. For longitudinal perforation of the sheets, one or more rollers 70 press the passing sheets 16 against the teeth 68.

In the embodiment illustrated in FIG. 3, the pressure rollers 70 are mounted on a single shaft 72 having its opposite ends rotatably mounted to side walls 50,52. The mounting arrangements 74,76 of shaft 72 to the sidewalls may include adjusting means, such as an eccentric, for varying the pressure of rollers 70 on the sheets.

The opposite ends of shaft 56 may or may not be adjustably mounted to side walls 50 and 52. In FIG. 3, it will be assumed that the counter-roller 54 is permanently set relative to the impression cylinder 28 and that the height of teeth 46 and 68 is the same. In this case, one or more grooves 78 are provided in the hyperboloid surface of the counter-roller so that they may come into registry with, while avoiding, the passing teeth 68 of the perforator strips 62.

Figure 6:
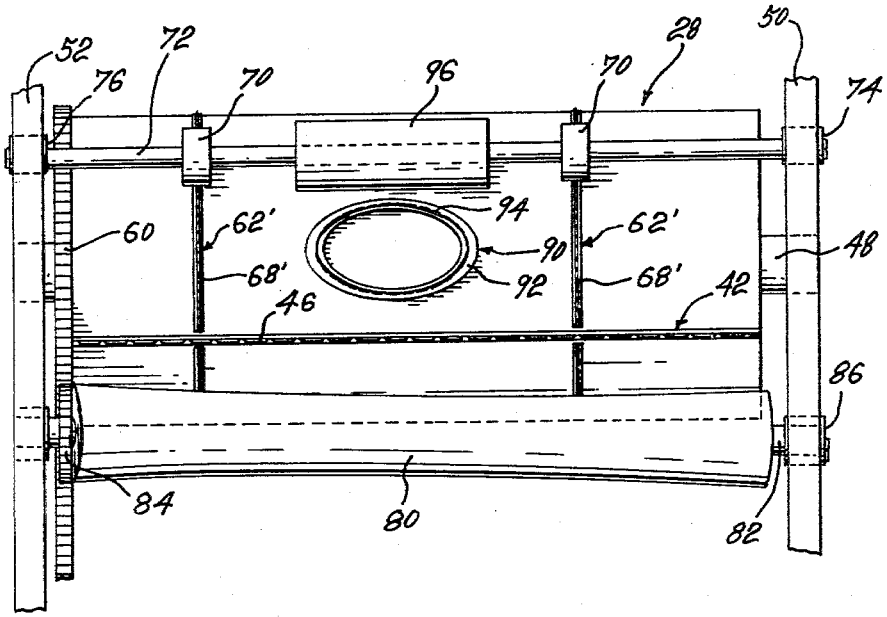
FIG. 6 is a plan view similar to FIG. 4 showing another variant of the present invention.

In cases where the counter-roller is adjustably mounted to the side walls of the machine, grooves 78 are not required, provided that the height of teeth 46 is greater than that of teeth 68. Referring to FIG. 6, such embodiment is illustrated, in which components which are the same as that used in the embodiment illustrated in FIG. 3 bear the same reference numeral. In this embodiment, a counter-roller 80 of similar construction to counter-roller 54, but without grooves, is mounted on a shaft 82 of skew inclination relative to shaft 48 of the impression cylinder 28. One end of shaft 82 supports a gear wheel 84 in meshing engagement with gear wheel 60 of the impression cylinder 28 while the opposite end of shaft 82 includes an adjusting mechanism 86 to vary the distance separating counter-roller 80 from the impression cylinder 28. By providing perforator strips 62' with teeth 68' smaller than teeth 46 and by varying the distance between cylinder 28 and counter-roller 80, no contact is made by strips 62' on the counter-roller. As a specific example, illustrative but not limiting, the height of teeth 46 may be 37 mil. while that of teeth 68' may be 23 mil.

Figure 7:
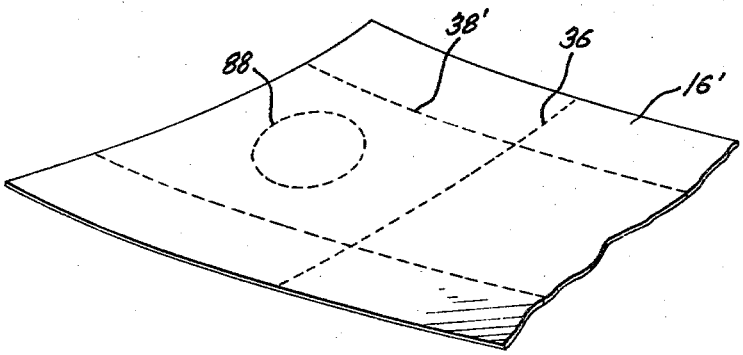
FIG. 7 is a perspective view showing in part a sheet which has been marked by the marking arrangement shown in FIG. 6.

This embodiment also enables the mounting of additional marking means on the outer surface of the impression cylinder. Hence, a sheet 16', such as shown in FIG. 7, may be perforated in a single operation with longitudinal and transverse perforations 38' and 36 together with perforation 88 of circular configuration 88. FIG. 6 shows a die perforator 90 affixed to the outer surface of impression cylinder 28 and including a base 92 having its backing adhesively mounted to the impression cylinder 28 and a series of teeth 94 having a height substantially the same as that of teeth 68' and smaller than that teeth 46 of perforator strip 42. To effect perforation of sheet 16', an additional pressure roller 96 is mounted on shaft 72 with a width sufficiently large to include the total configuration of die perforator 90.

The present invention should not be limited to the embodiments illustrated since various changes and modifications may be brought without departing from its scope. Indeed, there may be provided more than one transverse perforator strip. Also, there may be provided a combination of perforators, slitters and scorers so that the printed sheet may bear at the delivery station, a series of perforations, scores and slits of different configuration and angle to one another.

The embodiments of the invention in which an exclusive property or privilege is claimed are defined as follows:

1. An offset duplicating machine comprising, in combination:

a loading station for stacking sheets to be printed;

means for successively conveying separate sheets from said loading station;

a printing station for printing sheets conveyed from said loading station;

means for transferring printed sheets from said printing station;

an impression cylinder receiving said printed sheets from said transferring means and having a rotational axis perpendicular to the axis of travel of said printed axis;

first marking means on said impression cylinder and including a sheet marking edge extending lengthwise of said impression cylinder;

rotatable counter-roller mounted adjacent said impression cylinder and having a rotational axis of skew inclination relative to the rotational axis of said impression cylinder, said counter-roller having an outer surface of hyperboloidal shape lying adjacent to the outer surface of said impression cylinder and contacting said marking edge progressively along the length thereof as said sheets travel successively between said impression cylinder and said counter-roller whereby said sheets are marked transversely;

second marking means mounted on said impression cylinder in a plane coincident with the line of travel of said sheets; said second marking means defining a marking edge whereby said sheets may be marked lengthwise;

said first and second marking means consisting of elongated metallic strips having a base adhesively secured to the outer surface of said impression cylinder and teeth integral with said base, said teeth of said first-mentioned marking means being higher than that of said second marking means;

pressure roller having a rotational axis parallel to the rotational axis of said impression cylinder; said pressure roller being mounted circumferentially spaced from said counter-roller in the direction of the transferring means and extending over said second marking means whereby lengthwise perforation of said sheets is effected as said sheets pass between said pressure roller and said impression cylinder toward said first marking means, and a delivery station for receiving said printed and marked sheets.

2. An offset duplicating machine as defined in claim 1, further comprising means for adjusting the pressure exerted by said pressure roller on said sheets passing over said second marking means.

3. An offset duplicating machine as defined in claim 1, comprising groove on said counter-roller; said groove being provided on said counter-roller so as to come in registry with said teeth of said second marking means thereby avoiding contact by said teeth of said second marking means on the outer surface of said counter-roller.

4. An offset duplicating machine as defined in claim 1, further comprising adjusting means at opposite ends of said counter-roller for varying the distance separating said counter-roller from said impression cylinder.

5. An offset duplicating machine as defined in claim 1, further comprising third marking means having a predetermined shape mounted on the outer surface of said impression cylinder; and pressure roller for carrying out the marking of said sheets when passing between said third marking means and said pressure roller.

6. An offset duplicating machine as defined in claim 1, wherein said third marking means consist of a base adhesively secured to said impression cylinder and of a marking edge integral with said base; the height of said marking edge of said third marking means being smaller than that of said first-mentioned marking edge.

* * * * *